United States Patent [19]

Spagnuolo et al.

[11] Patent Number: 5,037,089

[45] Date of Patent: Aug. 6, 1991

[54] EXERCISE DEVICE HAVING VARIABLE RESISTANCE CAPABILITY

[76] Inventors: Patrick Spagnuolo, 16 Bower Pl., Huntington, N.Y. 11743; Carl Furci, 55 Withers St., Brooklyn, N.Y. 11211

[21] Appl. No.: 767,070

[22] Filed: Aug. 19, 1985

Related U.S. Application Data

[63] Continuation-in-part of Ser. No. 462,353, Mar. 28, 1983, abandoned.

[51] Int. Cl.[5] ..... A63B 21/00

[52] U.S. Cl. ..... 272/134; 272/118; 272/129; 272/Dig. 4

[58] Field of Search ..... 272/118, 134, DIG. 4, 272/5, 6; 128/25 R

[56] References Cited

U.S. PATENT DOCUMENTS

| | | | |
|---|---|---|---|
| 3,614,097 | 10/1971 | Blickman | 272/118 X |
| 4,144,568 | 3/1979 | Hiller et al. | 272/70 X |
| 4,208,049 | 6/1980 | Wilson | 272/140 X |
| 4,244,021 | 1/1981 | Chiles, III | 272/DIG. 6 X |
| 4,253,662 | 3/1981 | Podolak | 272/143 X |
| 4,256,302 | 3/1981 | Keiser et al. | 272/118 |
| 4,411,424 | 10/1983 | Barnett | 272/134 X |
| 4,546,971 | 10/1985 | Reasoch | 272/117 X |
| 4,556,214 | 12/1985 | Petrofsky et al. | 272/117 |
| 4,600,196 | 7/1986 | Jones | 272/134 |
| 4,609,189 | 9/1986 | Brasher | 272/118 |
| 4,621,807 | 11/1986 | Stramer | 272/118 X |
| 4,650,185 | 3/1987 | Cartwright | 272/117 |
| 4,666,149 | 5/1987 | Olschansky et al. | 272/134 X |

*Primary Examiner*—Richard J. Apley
*Assistant Examiner*—Joe H. Cheng
*Attorney, Agent, or Firm*—Lieberman, Rudolph & Nowak

[57] ABSTRACT

An exercise device for use in weight training, body building, and the like, in which exertion against resistance is utilized to promote bodily development. The device has a training load with a plurality of individual weights, and the number of weights are selected by mechanical actuators controlled by the user of the device. Weights are attached to or shed from the training load in response to commands from the exercising individual, or automatically selected by command signals from biofeedback data from the body of the exercising individual.

10 Claims, 5 Drawing Sheets

EXERCISE DEVICE HAVING VARIABLE RESISTANCE CAPABILITY

This is a continuation-in-part of U.S. application Ser. No. 06/462,353 filed on Mar. 28, 1983, now abandoned.

BACKGROUND OF THE INVENTION

The present invention relates to a weight-shedding exercise device and in particular to a novel exercise apparatus which permits and assists the user in achieving optimum weight training benefits by means of reducing the training load at certain critical times, or under certain bodily conditions in a particular training sequence.

Weight training, body building, some forms of physical therapy and other types of exercise involving exertion against resistance typically employ either weight lifting of traditional barbells, or use of exercise machines, such as the type shown in U.S. Pat. No. 4,256,302 to Keiser, et al.

U.S. Pat. No. 3,614,097 to Blickman similarly discloses a classic weight lifting apparatus with a plurality of weights mounted upon a rod, and a sliding bolt assembly with a bar, together used to selectively secure a lower weight to the stack.

The prior art also shows various devices for recording and monitoring exercise data, including those shown in the Flavell patent, the Atlantis SX2 machine and U.S. Pat. No. 4,144,568.

Another exercise device using isometrics is disclosed in U.S. Pat. No. 4,411,424 to Barnett, which enables the user to push and pull, using one arm against the other, through a complicated series of lever assemblies and pullies.

Still another isometric device is disclosed in Russian Physical Inst. Disclosure No. 469,457 by Pavlov to provide exercise for bedridden patients, providing attachment of auxiliary plates to a central load plate through use of electromagnets.

The concept of displaying biofeedback data on an ergometric bicycle exercise device is disclosed in U.S. Pat. No. 4,244,021 to Chisles III, which further calls for fixed load setting, of little applicability to weight lifting devices.

However, none of the known prior art devices confront, or solve, the problem of providing a simple and inexpensive method to give the user the benefits and advantages of selectively reducing the training load for the last several repetitions of a set of weight lifting exercises or the like.

It is known that weight lifters, when utilizing an exercise machine, will often provide each other with assistance to achieve elevation of a given weight or training load for the last several repetitions of an exercise set. It is at this point of near exhaustion, where the person exercising would find it difficult, impossible, or very possibly dangerous to continue lifting the same weight load, that the greatest benefit and advantages result to improving the muscle system.

Athletes like Arnold Schwarzenegger, the seven-time Mr. Olympia winner and star of the Conan movie series, uses this descending set training method, as Bill Reynolds, Editor-in-Chief of *Muscle and Fitness*, has stated in an article entitled "Blast to the Max with Descending Sets", in the July 1983 edition. Accordingly, Mr. Schwarzenegger trains with a partner, who strips weights from the barbells, at near the point of failure to thereby enable Mr. Schwarzenegger to force three or four more repetitions.

Rather than requesting assistance to reduce the perceived training load at the crucial and final portion of an exercise set, it is, of course, possible for the weight lifter to terminate the exercise, manually reduce the training load and then continue the exercise cycle. This procedure has many disadvantages not the least of which is that the brief time required to manually reduce the training load would substantially reduce the training benefit. Also, of course, there is the considerable inconvenience in stopping and starting an exercise at or close to the point of near exhaustion.

It is therefore, an object of the present invention to provide a means for rapidly reducing the training load by weight shedding in order to achieve optimum training results.

It is a further object of the present invention to provide weight shedding means which will shed the amount of weight desired by the user, neither more nor less, and allow such selection to be made without substantial chance of error.

It is another objection of this invention to provide an exercise apparatus with weight shedding means that can be responsive to biofeedback from the user, including such factors as temperature, muscle strain and pulse rate, so as to automatically shed weights at the proper point for maximum physiological benefit.

It is a still further object of the present invention to provide a safety switch which permits the user to shed weight, whether under manual control or biofeedback or otherwise, if sudden exhaustion, accident or the like should be encountered.

It is a still further and general object of the present invention to provide an exercise device that can be programmed to shed weights in accordance with a predetermined formula or plan, based for instance on time or number of repetitions without further user intervention.

SUMMARY OF THE INVENTION

In accordance with the invention, a weight shedding exercise device, adapted to enable the user to maximize training and physiological benefit, includes apparatus for enabling a user to exert force against a training load comprising a plurality of individual weights.

It is a feature of this invention that the exercise device is provided with electrically operated mechanical actuators which can selectively shed individual weights from the training load.

It is a further feature of the instant invention that the mechanical actuators of the exercise device include solenoids and springs, which solenoids are powered by a low voltage DC supply thereby eliminating shock hazard to the exercising individual.

It is yet another feature of the instant invention to provide an emergency switch, such that the user can immediately disengage all the weights from the training load.

It is another feature of the instant invention that the exercise device is provided with a microprocessor to replace or supplement manual control over weight shedding.

It is a still further feature of the present invention that the exercise device is provided with sensors of temperature, pulse rate and muscle strain, which sensor data is evaluated by the microprocessor, to allow weight to be shed at a preprogrammed point determined by the biofeedback characteristics of the exercising individual.

It is another feature of the present invention that the microprocessor is also programmable to shed weight at a predetermined point based on the time or number of exercise cycle repetitions, thus providing precise control over the nature of the exercise.

BRIEF DESCRIPTION OF THE DRAWINGS

These and other objects and features of the invention will be more fully appreciated from the following detailed description when taken in conjunction with the accompanying drawings, in which.

DESCRIPTION OF THE PREFERRED EMBODIMENT

Figure 1:
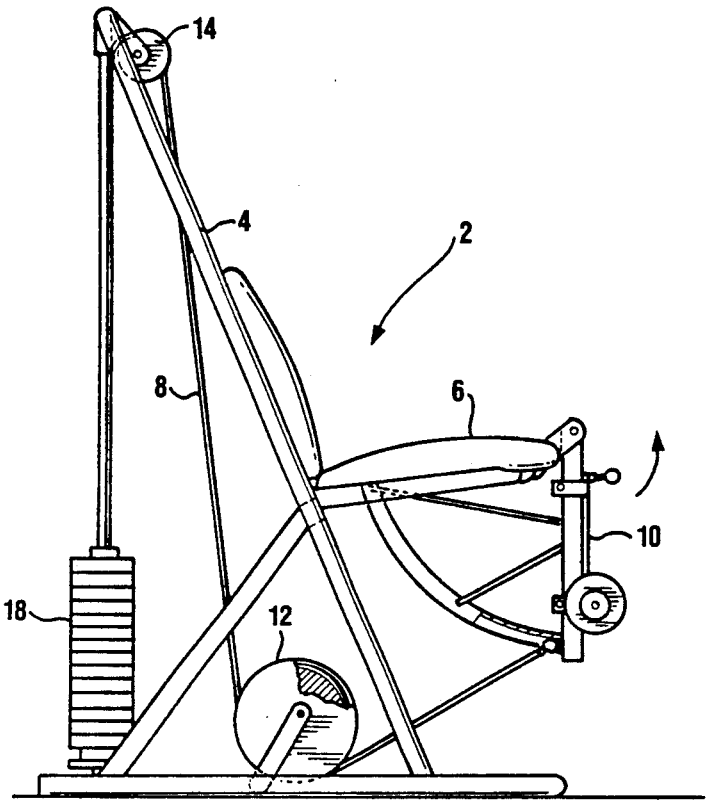
(PRIOR ART) FIG. 1
FIG. 1 is a side elevational view of a prior art exercise device.

In accordance with the present invention, and referring now to FIG. 1, there is provided one example of a prior art exercise device 2 which includes a frame 4 and user seat 6. Depending on the type of exercise the device is designed for, user seat 6 can be omitted and replaced with other apparatus designed to allow training load 18 to be raised and lowered by the exercising individual.

Training load 18 is connected to leg lifting apparatus 10 via pulleys 12 and 14 and connecting cable 8. It is apparent from FIG. 1 that as leg lifting apparatus 10 is raised in the direction of the upward pointing arrow, training load 18 will be elevated to provide the resistance necessary to achieve a training effect.

Figure 2:
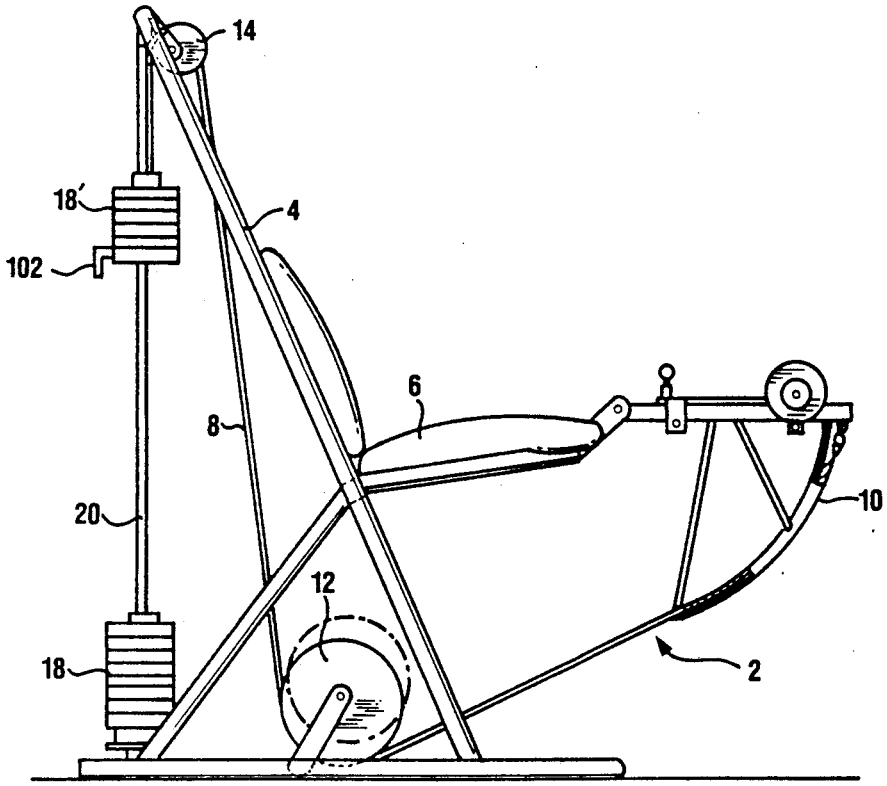
(PRIOR ART) FIG. 2
FIG. 2 is a second side elevational view of the prior art exercise device.

Referring now to FIG. 2, in typical prior art exercise devices, training load 18 is comprised of a plurality of individual weights, each of which have one or more holes therein such that the individual weight slide up and down on bar 20 as leg lifting apparatus 10 is operated by the user of the exercise device. Weight is either added or deleted from the training load via use of pin 102. More particularly, pin 102 is inserted into a hole on the side of an individual weight, connecting that weight to cable 8, such that all weights above pin 102 (weight 18') are part of the training load and are elevated by the operator of the device while the remaining weights 18 remain in a stationary rest position. It is apparent from FIG. 2 that the amount of weight included in a particular training load is varied by simply moving pin 102 to a different weight in the group, thereby changing the total training load.

Users of such weight machines have been observed seeking and receiving help from other people, if possible, who assist in pushing, pulling or otherwise exerting against the weight for the last several repetitions of a particular exercise set.

Figure 3:
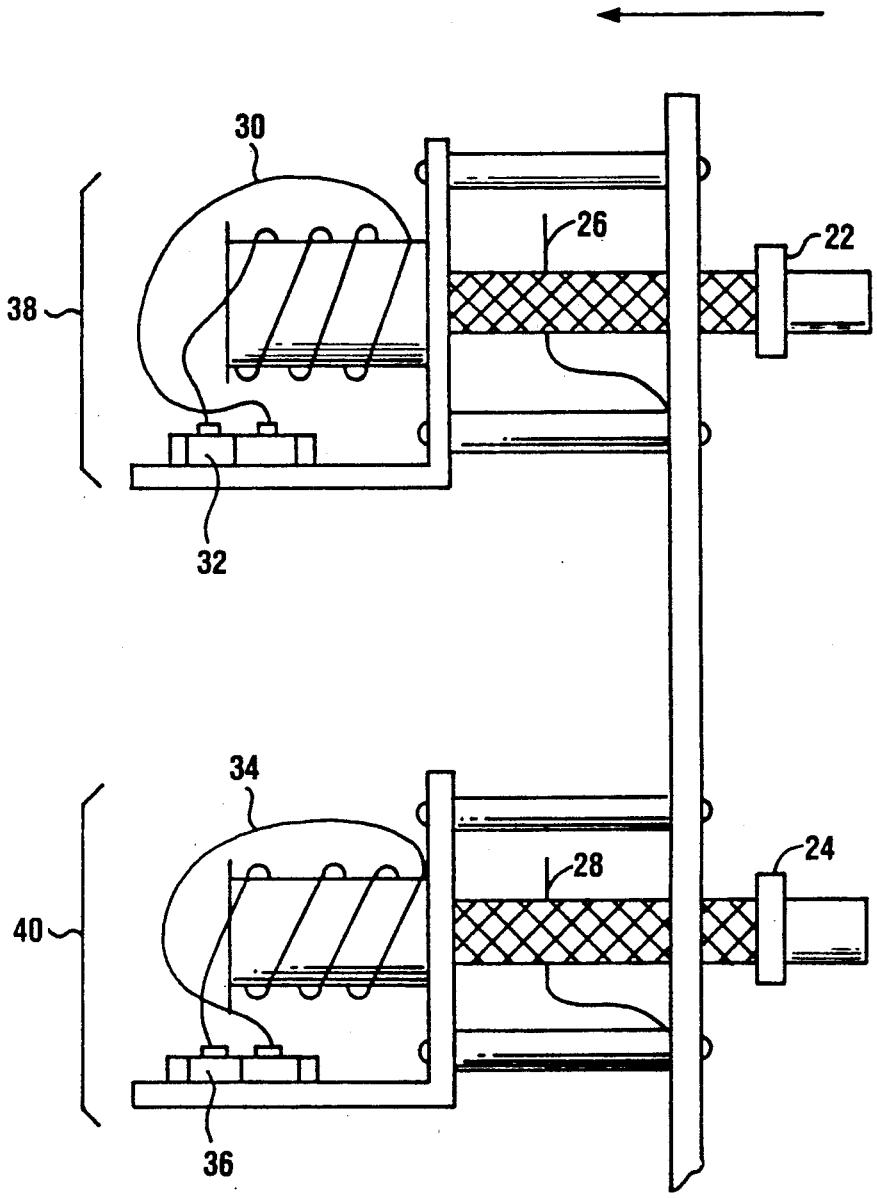
FIG. 3 is a detailed side elevational view of the mechanical actuators utilized with the apparatus of the instant invention.

FIG. 3 shows two electrically operated mechanical actuators of the instant invention designed to automatically select the number of individual weights to include within a training load and to shed weight from a training load in response to command signals from the user of the exercise device. One actuator is provided for each weight in the training load 18 (FIG. 1), and for simplicity, two such actuators, 38 and 40, are shown in FIG. 3. Each mechanical actuator includes a solenoid operated pin 22 and 24 which replaces pin 102 (FIG. 2) and is extended into the hole on the side of a particular weight when the controlling solenoid is in a non-energized state. It is, of course, understood that the mechanical actuators are mounted adjacent to the individual weights in a training load such that pins 22 and 24 are extended into each individual weight included in training load 18 and into connecting cable 8 (FIG. 2), as is described in greater detail below.

Each of pins 22 and 24 are held in position by springs 26 and 28 which insure that each individual weight is continuously supported by its associated solenoid 30 and 34, each solenoid having power applied via barrier terminal strips 32 and 36 which provide electrical isolation between the associated power supply voltage and the mechanical actuator apparatus.

When any of solenoids 30 and 34 are energized its associated pin is withdrawn in the direction of the arrow in FIG. 3 compressing springs 26 and 28 and shedding a weight or weights from the training load. When all solenoids are energized the training load is reduced substantially to zero while when all solenoids are not energized the training load is at a maximum.

Figure 4:
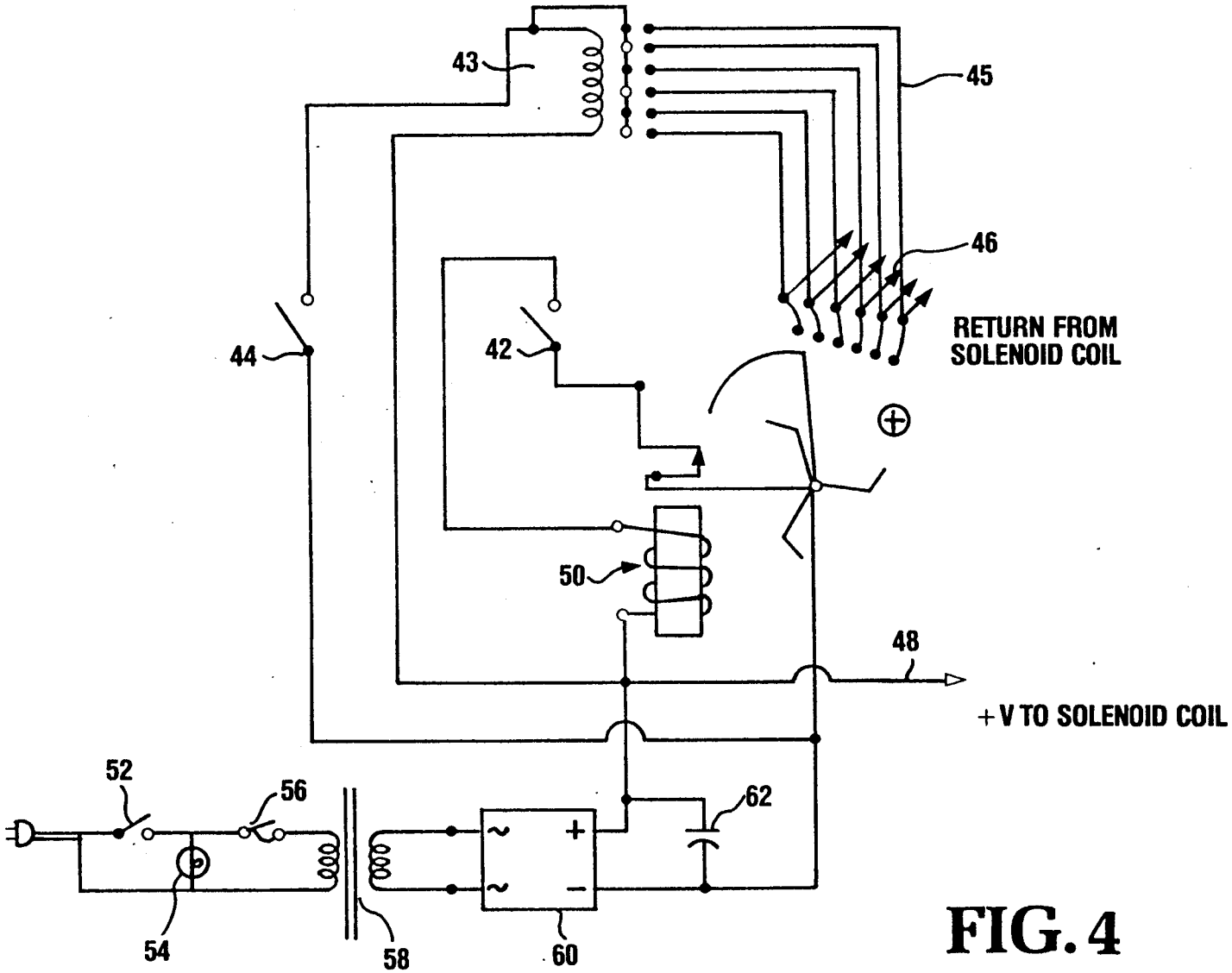
FIG. 4 is a circuit diagram of the basic control circuitry of the instant invention.

FIG. 4 shows one embodiment of the apparatus utilized to initially select the training load or to shed weights from the training load during an exercise set. Power is supplied to the circuitry via a standard line cord and on/off switch 52. The circuitry is fused with fuse 56 and pilot lamp 54 indicates that the circuitry is in operation. The AC voltage received from the power cord is reduced through step down transformer 58 and the AC voltage is then converted into a lower power DC voltage by bridge rectifier 60. The DC output voltage from bridge rectifier 60 is filtered by filter capacitor 62.

The positive output of the DC power supply is applied to each of the solenoid coils (two of which are shown in FIG. 3) via connection 48 and also supplied to stepping relay 50. The negative output of the DC power supply is applied to the contacts 46 of the stepping relay to provide a return path from the solenoid coils. For simplicity, six solenoid coils are called for in FIG. 4, although the number of coils corresponds to the number of pins, and the number of weights.

When the circuitry in FIG. 4 is not energized, all of the individual weights are included in the training load as previously discussed. Switch 42 functions as a weight shedding switch such that each time switch 42 is actuated, stepping relay 50 will increment one of its contacts one position, thus energizing a particular solenoid coil to remove one weight from the training load. In operation, therefore, the operator of the exercise device would begin with a predetermined number of weights being selected through proper actuation of switch 42.

For example, if there are a total of six weights in the stack, and four are to be applied as the training load, all but two pins will be in the unenergized state, switch 42 will have been pulsed twice, and the ratchet of stepping relay 50 will be in the second position, at the second contact in a clockwise direction in FIG. 4, with both the first and second contacts and solenoids energized.

If the exerciser desires, during an exercising set to shed one or more weights, switch 42 is actuated by him thereby retracting the pin(s) and shedding the desired number of weights from the training load. It is, of course, understood that switch 42 would be conveniently located on the exercise device to be well within reach of the individual when exercising. Switch 42 could, for example, be maintained within arms reach of the individual or alternatively could be placed within reach of the individual's foot on the floor near the exercise device. Also provided is safety switch 44 which could, for example, be an additional switch maintained on the floor near the exercise device to allow shedding of weights in the event of an emergency or to shed weights if, for example, switch 42 becomes inoperative.

This embodiment also provides this safety switch 44 such that when closed, it actuates a six poles single throw relay 43 which energizes all the solenoids simultaneously through lines 45, and thus sheds all the weights in the event of injury, accident or other emergency. It is to be understood that the number of poles on the relay 43 corresponds with the number of solenoids, and weights in the stack. As with switch 42, switch 44 can be placed in close proximity to the user.

Figure 7A:
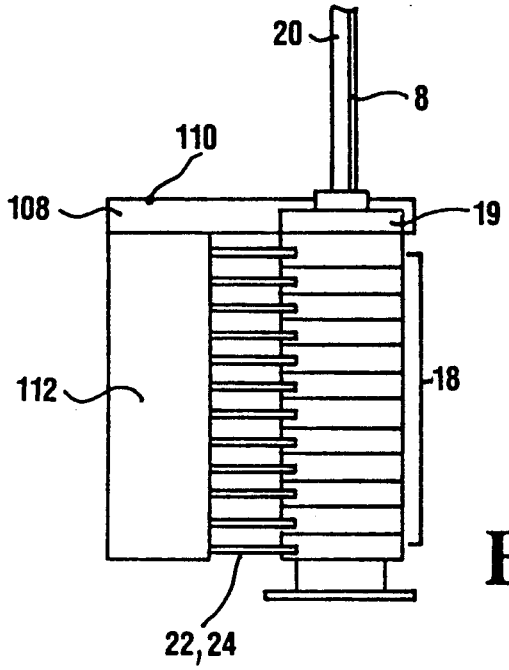
Figure 7B:
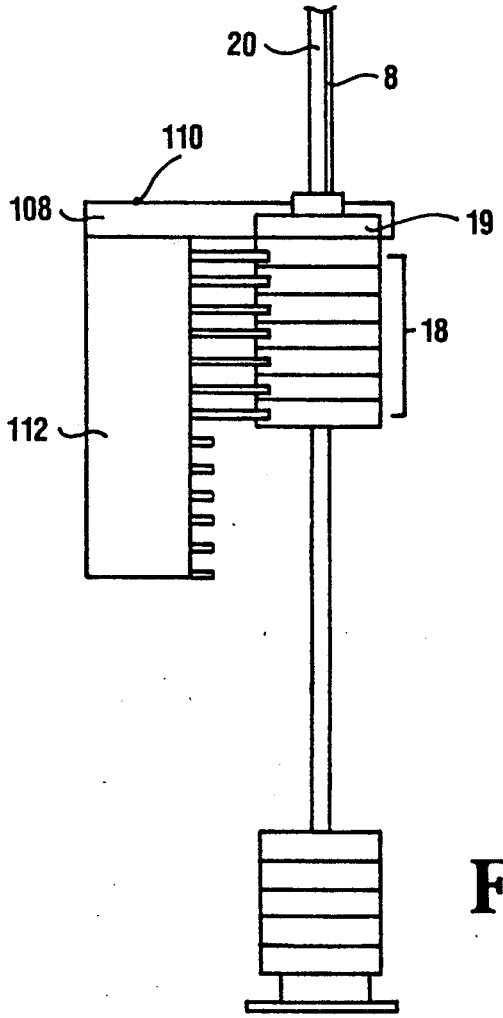

As shown in FIG. 7, the solenoids can be conveniently held in solenoid housing assembly 112. The number of solenoids corresponds with the number of weights in the stack. The assembly 112 can be attached directly to connecting cable 8 at point 110 at the top thereof, or alternatively, can be connected via a retaining bracket 108 to the top weight 19 of stack 18. In the latter case, one less solenoid can be used, since the top weight 19 is directly attached to assembly 112. Stack 18 is in turn placed around pole 20, as shown in FIGS. 1 and 2. Accordingly, when the cable is not attached to point 110, the pins connect through the weights and into the cable, in the normal manner, and when the cable is attached to point 110, the pins no longer extend through the cable, and instead just support the individual and corresponding weights.

In this manner, when solenoids are in a nonenergized mode, all the pins are out, and inserted into their corresponding weights on stack 18, such that the entire stack becomes the training load. As switch 42 is activated, solenoids sequentially become activated, and remain in this state, and the corresponding weight(s) drop to the floor, along pole 20.

It is important to note that the ease and simplicity of attachment of solenoid housing assembly 112, allows for the application of this aspect of the instant invention to almost every conventional weight stack training device, in either of the two manners referred to above, and shown in the diagrams.

Figure 5:
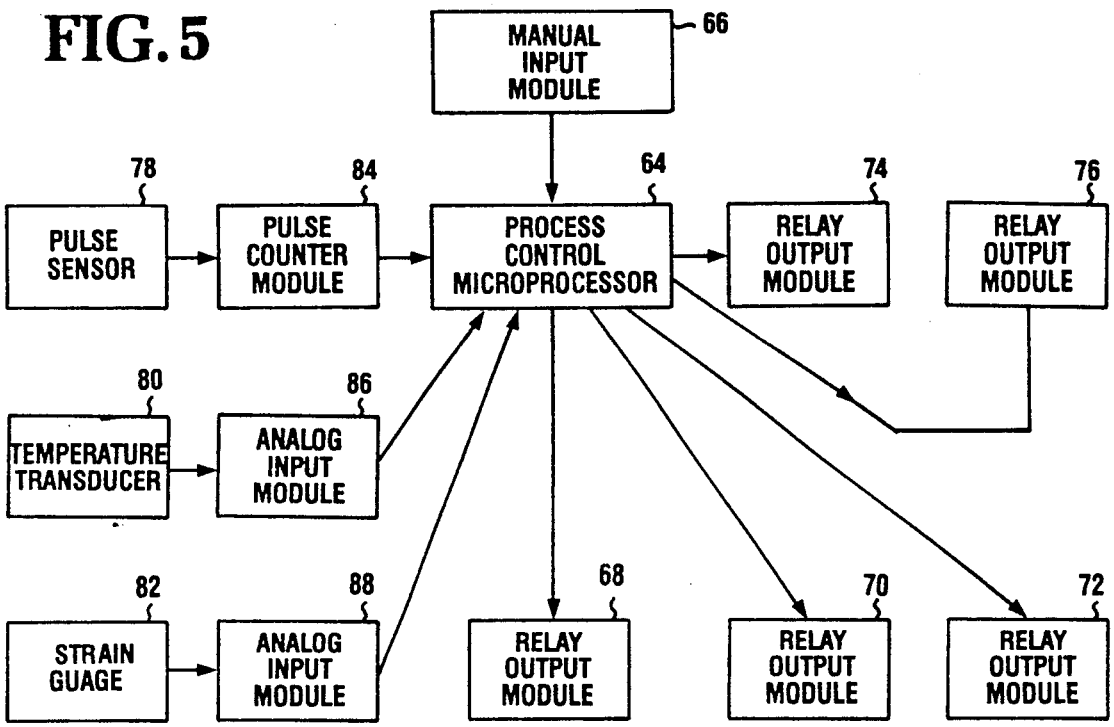
FIG. 5 is a block diagram of the microprocessor controller of the instant invention.
Figure 6:
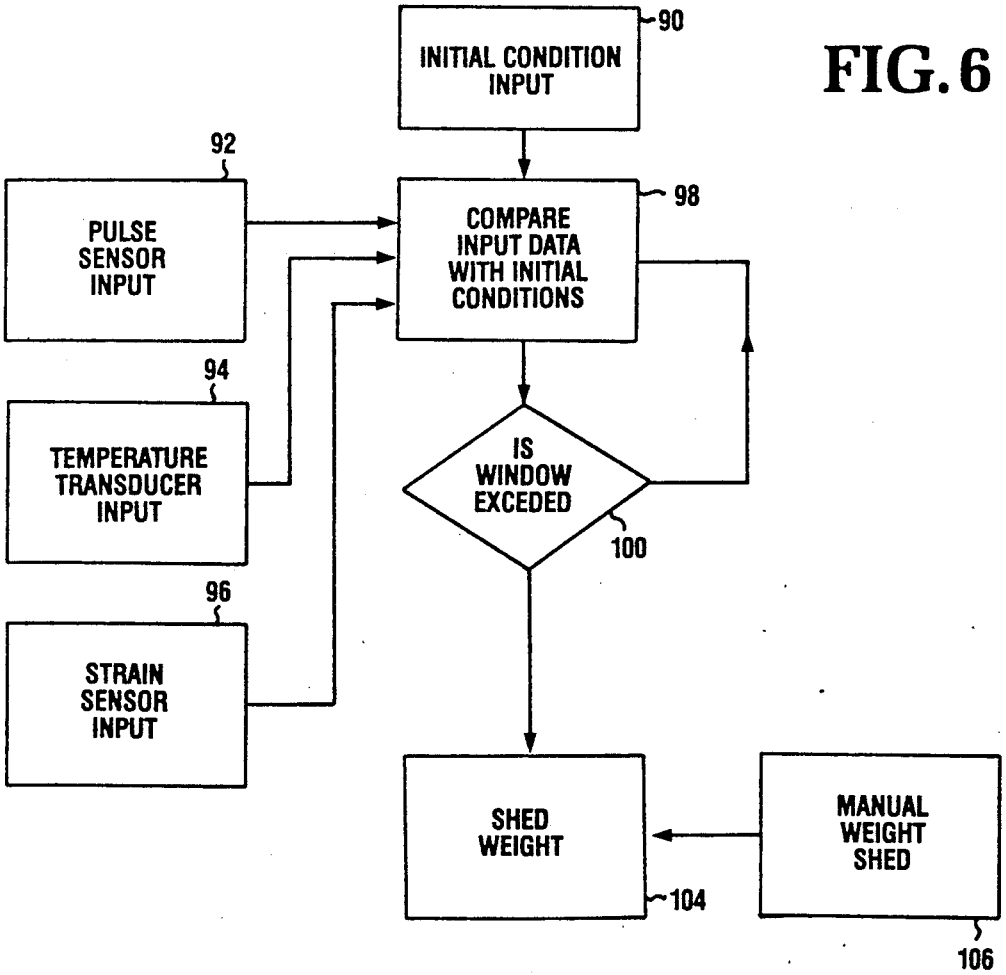
FIG. 6 illustrates a microprocessor flow diagram for the block diagram of FIG. 5, and FIG. 7A and FIG. 7B are side elevational views of the operation and engagement of solenoids and pins on a weight stack.

FIGS. 5 and 6 show a second embodiment of the invention in which microprocessor control is utilized in connection with the embodiment of FIG. 4, by replacing switches 42 and 44 therein at the respective points of electrical attachment. This microprocessor control provides weight shedding in response to biofeedback data from the individual utilizing the exercise device. More particularly, FIG. 5 illustrates a number of individual sensors such as pulse rate sensor 78, temperature transducer 80 and strain gauge 82. Pulse rate sensor 78 could, for example, consist of a light source and photo cell connected to the skin surface with a cuff-like device and this sensor is in turn connected to pulse counter module 84 which will amplify the output of pulse rate sensor 78 and provide digital data on the pulse rate of an exercising individual. This data in turn would be applied to process control microprocessor 64 for processing as described below.

Temperature transducer 80 could, for example, consist of a transducer to measure body surface temperature sensed by a thermistor attached to the body. This data is in turn fed into a bridge type instrumentation amplifier and A/D converter 86 to convert the analog information into digital data for use by microprocessor 64.

Strain gauge 82 could consist, for example, of a resistive strain gauge embedded in a cuff placed around the arm of the exercising individual. Strain gauge 82 is designed to exhibit a change in resistance with the output of the strain gauge being applied to analog input module 88. Module 88 would consist of a suitable amplifier and an A/D converter to convert the analog strain gauge into digital data for use by microprocessor 64.

Manual input module 66 is utilized to present data into microprocessor 64 to permit the microprocessor to evaluate the data received from the various sensors described above. More particularly, the user of the exercise device would input into the microprocessor a certain pulse rate range, body temperature range, and muscle flex parameters all of which would be based on an individual's own body characteristics, as well as knowledge of the exerciser's past history. Microprocessor 64 would then evaluate the data from the various sensors, compare this data with the manual input module data and decide at which point weights should be shed from the training load. Relay output modules 68 through 76 represents electrically operated mechanical actuators to shed one or more weights in the training load. It is also understood that microprocessor firmware could be designed for microprocessor 64 to permit programming the exercise device to shed weights at predetermined times during an exercise set or to shed weight after a predetermined number of exercise repetitions during an exercise set.

FIG. 6 illustrates a flow chart for use with the microprocessor of FIG. 5, wherein as described above, the input data from the various sensors (92, 94 and 96) would be compared (98) with initial input conditions (90) and, if the initial conditions (90) were exceeded, i.e., the window was exceeded (100), weight would be shed 104 from the training load. Alternatively, if the initial conditions were not exceeded i.e., the window was not exceeded (100), the microprocessor would continue to monitor the input data and compare (98) with the initial programming (90) until the preset conditions were reached. For example, if strain sensor input (96) registers a high strain on the exerciser, thus requiring a weight shedding (104), this strain data is compared (98) with the initially inputted condition (90), and if properly set by the exerciser, should exceed (100) the input condition (90), and thus shed weight (104). Alternatively, if the exerciser is experiencing low strain and the sensor so indicates (below the inputted valve), then the microprocessor will continue to monitor the conditions, and no weight is shed. Also shown in FIG. 6 is the manual weight shed 106 which could be attached to the microprocessor configuration of FIG. 5, and corresponds with that shown in FIG. 4, to permit manual weight shedding in case of emergency or malfunction of the microprocessor.

While preferred embodiments of the present invention have been discussed and described, it should be recognized that various modifications can be made which will not modify or defer the scope of the present invention.

We claim:

1. A weight training exercise device comprising:

a plurality of weights normally situated in a rest position and vertically secured to a lifting bar, means removable attached to said plurality of weights and operable by a user of the weight training exercise device for repeatedly moving a predetermined number of said plurality of weights from said rest position to an elevated exercise position, and for returning said predetermined number of said plurality of weights from said elevated exercise position to said rest position, and means responsive to the command signals inputted by said user from an input means for controlling said moving means to an initially predetermined number of said plurality of weights and to selectively reduce said predetermined number of said plurality of weights during an exercise set, wherein said controlling means including a plurality of mechanical actuators, each one of said mechanical actuators being associated with a respective one of said plurality of weights and means for individually operating each one of said mechanical actuators in response to said command signals, wherein each one of said mechanical actuators including a solenoid driven pin, said pin being inserted into the respective one of said plurality of weights when said solenoid is nonenergized and being withdrawn from said respective one of said plurality of weights when said solenoid is energized.

2. The weight training exercise device in accordance with claim 1, wherein said operating means includes a stepping switch for selectively energizing said solenoid driven pins.

3. The weight training exercise device in accordance with claim 2, wherein said controlling means further includes an emergency user-engagable switching means for energizing all of said solenoid driven pins thereby returning said plurality of weights to the rest position.

4. A weight training exercise device comprising:

a plurality of weights normally situated in a rest position and vertically secured to a lifting bar, means removable attached to said plurality of weights and operable by a user of the exercise device for repeatedly moving a predetermined number of said plurality of weights from said rest position to an elevated exercise position and for returning said predetermined number of said plurality of weights from said elevated exercise position to said rest position, wherein said moving means including a plurality of mechanical actuators, each one of said mechanical actuators being associated with a respective one of said plurality of weights, means for individually operating each one of said mechanical actuators, each one of said mechanical actuators including a solenoid driven pin, said pin being inserted into the respective one of said plurality of weights when said solenoid is nonenergized and being withdrawn from said weight when said solenoid is energized, means for monitoring bodily functions of the user and for converting information concerning said monitored bodily functions into digital data, and microprocessor means for evaluating said digital data, and means responsive to the evaluated digital data for automatically controlling said mechanical actuators by comparing an initially input data by said user and said predetermined number of said plurality of weights and for selectively reducing said predetermined number of said plurality of weights during an exercise set without further user intervention.

5. The weight training exercise device in accordance with claim 2, wherein said controlling means includes an emergency user-engagable switching means for energizing all of said solenoid driven pins thereby returning said plurality of weights to the rest position.

6. A weight shedding apparatus attachable to a weight training exercise device having moving means engagable with weights in a weight stack, said weight stack being vertically secured to a lifting bar and having a connecting cable, wherein said weight shedding apparatus comprising:

means responsive to the command signals inputted by said user from an input means for controlling said moving means to an initially predetermined number of weights in the stack, and to selectively reduce said predetermined number of weights during an exercise set, wherein said controlling means including a plurality of mechanical actuators, each one of said mechanical actuators being associated with a respective one of the weights in the stack, and means for individually operating each one of said mechanical actuators in response to said command signals, wherein each one of said mechanical actuators including a solenoid driven pin, said pin being inserted into the respective associated weight in the stack when said solenoid is nonenergized and being withdrawn from the associated weight when said solenoid is energized.

7. The weight shedding apparatus in accordance with claim 6, wherein said operating means includes a stepping switch for selectively energizing said solenoid driven pins.

8. The weight shedding apparatus in accordance with claim 6, wherein said controlling means further includes an emergency user-engagable switching means for energizing all of said solenoid driven pins thereby returning said weights to a rest position.

9. A weight shedding apparatus attachable to a weight training exercise device having moving means engagable with a plurality of weights in a weight stack, said weight stack being vertically secured to a lifting bar and having a connecting cable, wherein said weight shedding apparatus comprising:

means removable attached to said plurality of weights and operable by a user of the exercise device for repeatedly moving a predetermined number of said plurality of weights from said rest position to an elevated exercise position and for returning said predetermined number of said plurality of weights from said elevated exercise position to said rest position, wherein said moving means including a plurality of mechanical actuators, each one of said mechanical actuators being associated with a respective one of said plurality of weights, means for individually operating each one of said mechanical actuators, each one of said mechanical actuators including a solenoid driven pin, said pin being inserted into the respective one of said plurality of weights when said solenoid is nonenergized and being withdrawn from said weight when said solenoid is energized, means for monitoring bodily functions of the user and for converting information concerning said monitored bodily functions into digital data, and microprocessor means for evaluating said digital data, and means responsive to the evaluated digital data for automatically controlling said mechanical actuators by comparing an initially input data by said user and said predetermined number of said plurality of weights and for selectively reducing said predetermined number of said plurality of weights during an exercise set without further user intervention.

10. The weight shedding apparatus in accordance with claim 9, wherein said controlling means further includes an emergency user-engagable switching means for energizing all of said solenoid driven pins thereby returning said plurality of weights to the rest position.

* * * * *